United States Patent [19]

Everett

[11] 4,057,179

[45] Nov. 8, 1977

[54] GARMENT PRESSING MACHINES

[75] Inventor: Nicholas Wynne Everett, Carnforth, England

[73] Assignee: Ibis Engineers Limited, Kendal, England

[21] Appl. No.: 704,759

[22] Filed: July 12, 1976

[51] Int. Cl.[2] ..... A41H 5/00

[52] U.S. Cl. ..... 223/73

[58] Field of Search ..... 223/52, 70, 72, 73, 223/74

[56] References Cited

U.S. PATENT DOCUMENTS

| | | | |
|---|---|---|---|
| 2,469,742 | 5/1941 | Newhouse | 223/73 |
| 2.684,189 | 7/1954 | Campbell et al. | 223/73 |
| 2,729,370 | 1/1956 | Maxwell et al. | 223/73 |
| 2,759,644 | 8/1956 | Forse et al. | 223/73 |
| 2,760,698 | 8/1956 | Maxwell et al. | 223/73 |
| 3,462,051 | 8/1969 | Schleman | 223/72 X |
| 3,491,927 | 1/1970 | Biel | 223/73 |
| 3,568,900 | 3/1971 | Paris | 223/70 |

*Primary Examiner*—G. V. Larkin

*Attorney, Agent, or Firm*—Norris & Bateman

[57] ABSTRACT

A method for pressing and draping the sleeves of jackets by applying each sleeve to a sleeve form and positioning the sleeve thereon, expanding the form to expand the sleeve, bringing an internal pressing head into proximity with the junction of the sleeve and the jacket at the armhole, expanding the pressing head to a greater diameter than the armhole, applying steam and hot and cold air and vacuum in turn to the interior of the sleeve and allowing the sleeve to set, and a machine for carrying out the method comprising a left and right hand sleeve form for operation in sequence each form being expandible inside its respective sleeve with a pressing head expandible simultaneously with its sleeve form to a diameter greater than the diameter of the armhole and means for applying steam, air and vacuum in turn to the interior of the sleeve and allowing the sleeve to set while the opposite sleeve of a second jacket is being similarly treated on the other sleeve form.

5 Claims, 10 Drawing Figures

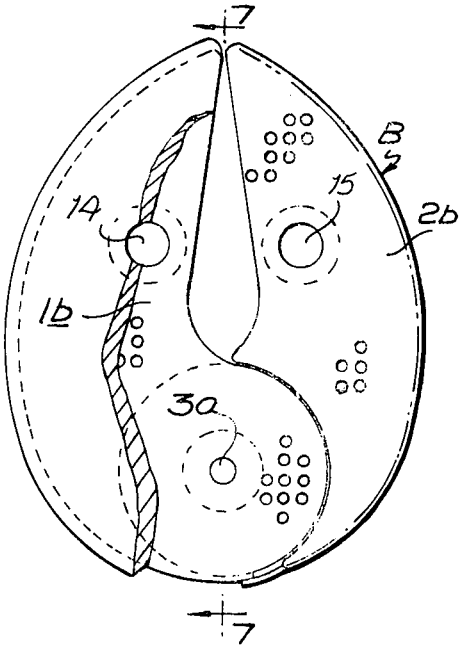
FIG. 6
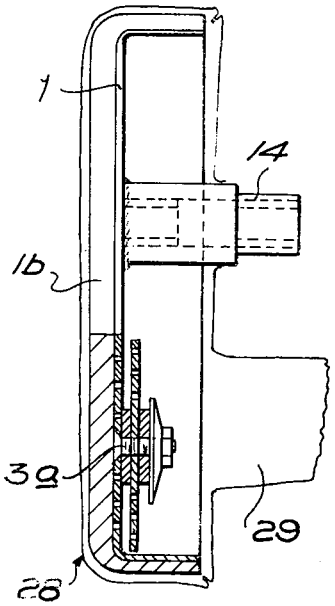
FIG. 7
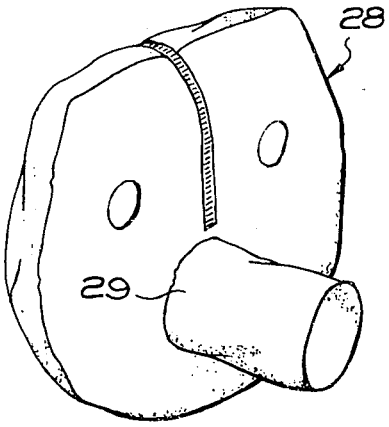
FIG. 8
FIG. 9
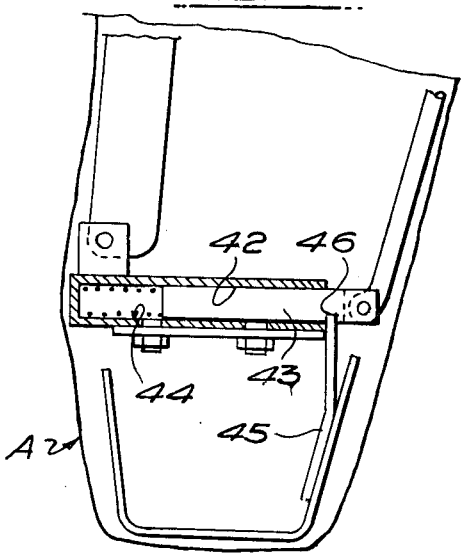

GARMENT PRESSING MACHINES

This invention relates to improvements in garment pressing machines and more particularly to a press for nipping and draping the sleeves of jackets or coats. A nipping and draping operation is one during which the seams between the sleeve of a jacket and the jacket body are pressed internally and the external portion of the sleeve at this junction is finished. In short, the armhold area of the jacket is pressed internally and externally.

A steaming and ironing press for the shoulders and sleeves of a jacket or coat has been proposed with a perforated substantially horizontal shoulder suport with a substantially vertical sleeve supporting surface forming part of the shoulder support and a hollowed shaping and pressing member for entering the sleeve through the arm hole at the junction with the sleeve. The seam is pressed and steamed around the armhole area of the seam between the body of the coat and the sleeve and the hollowed shaping and pressing member is then employed for the pressing of the remainder of the sleeve at a second operation.

The object of the invention is to provide a former for the steaming and pressing of the seams between the body and the sleeves of a jacket or coat in which pressing of the armhole seams and the pressing of the sleeve seams can be carried out as one operation at the same time.

According to the invention a method for the nipping and draping of the sleeves of jackets or coats comprises applying the sleeve to a sleeve form or support and positioning it thereon, expanding the form or support to expand the sleeve, bringing an internal pressing head into proximity thereto, expanding the pressing head to a diameter greater than the armhole, applying steam, hot or cold air and vacuum to the pressing head and allowing the sleeve to set.

The invention will be described with reference to the accompanying drawings.

Figure 4A:
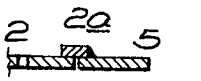
FIG. 4 is a front elevation of part of the sleeve support or form.
Figure 4:
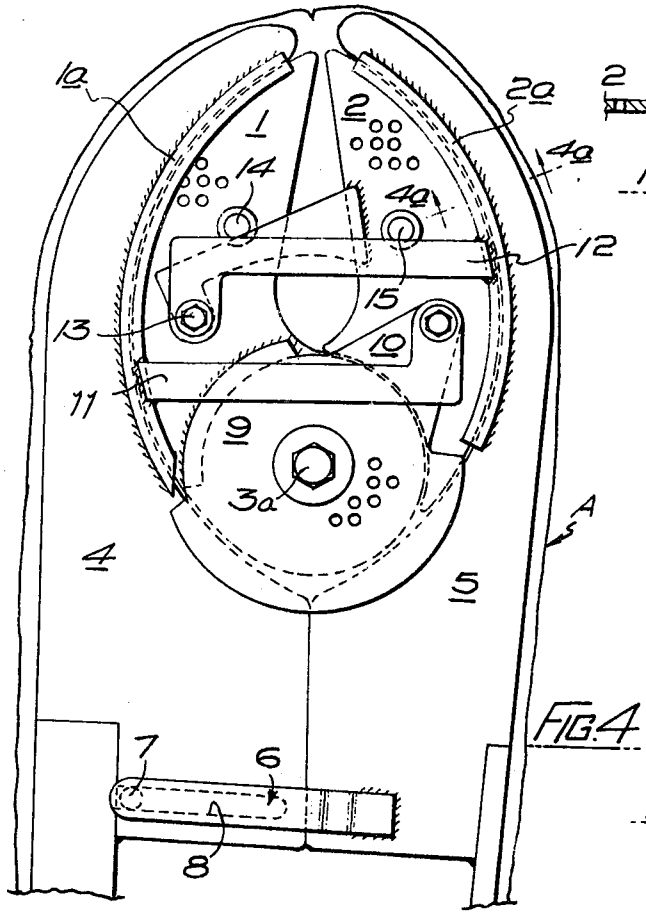

FIG. 4*a* is a section on line 4*a*—4*a* FIG. 4.

Figure 5:
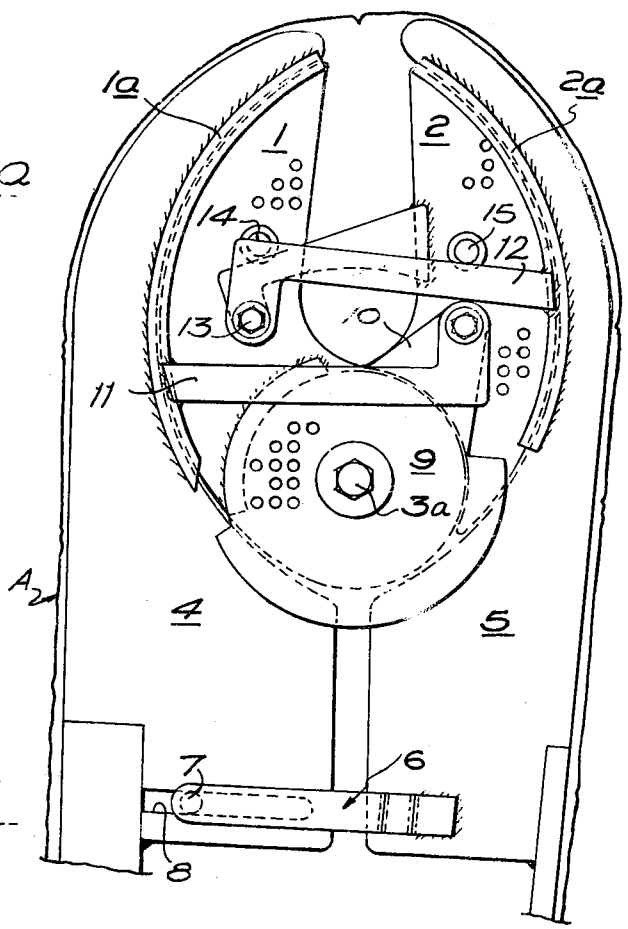

FIG. 5 is a view similar to FIG. 4 showing the support or form in an open position;

FIG. 6 is a front elevation of the pressing head;

FIG. 7 is a section on line 7—7 of FIG. 6;

FIG. 8 is a perspective view of the pressing head cover and

FIG. 9 is a section through the lower end of the sleeve form.

A press for nipping and draping the sleeves C of jackets or coats is formed with shoulder and sleeve supports for the right hand and left hand sides. The sleeve support A operates in conjunction with the shoulder form B which is formed as two plates 1,2 lying in the same plane, the plate 1 being pivoted to a stud 3*a* and both plates 1,2 being slidably mounted in a former 4,5 also formed intowo parts connected together by a link 6 affixed to the former 5 and provided with a pin 7 engaging in a slot 8 on the former 4.

A disc plate 9 is also pivoted on the stud 3*a* and provided with lug 10 on which is pivoted a link 11 affixed to the former 4.

A third link 12 affixed to the former 5 is pivoted to a fourth link at 13.

The plates 1,2 and the disc 9 are all perforated. The formers, 4,5 are provided with guides 1*a*, 2*a* mounted on their inner edges to guide the plates 1,2, respectively as shown in FIGS. 4 and 5.

Figure 3:
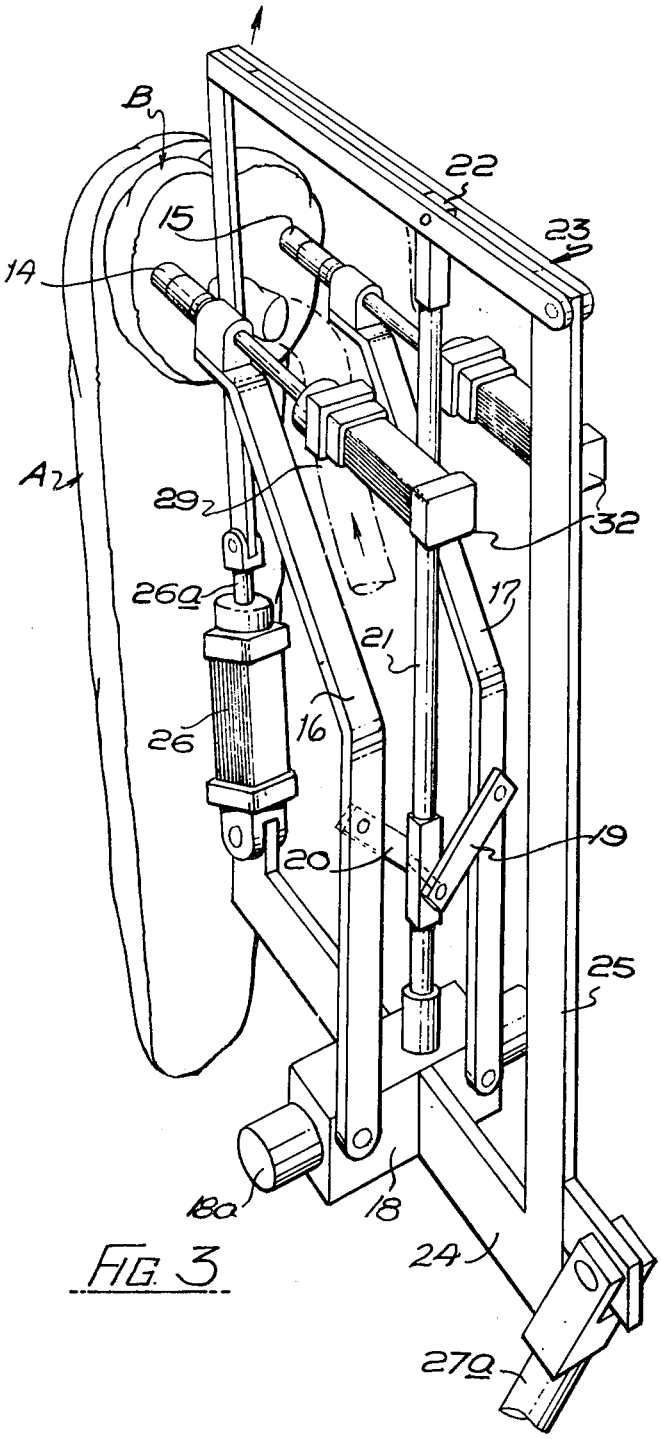
FIG. 3 is a fragmentary perspective view of the mechanism shown in FIG. 2.

In order to separate the plates 1,2 to expand the formers 4,5 according to the size of the armhole in the garment which is to be pressed the ends of two rods 14,15 are affixed respectively to the plates 1,2. The rods 14,15 are mounted to slide in arms 16,17 (FIG. 3) pivoted on a member 18 mounted on a pivot 19 in the machine frame. Each arm 16,17 is connected by links 19,20 to a rod 21 one end of which slides in the member 18 and the other end of which is pivoted on a member 22 of a frame 23, a second member 24 of which is integral with the member 18. The member 22 is pivoted to a member 25 of the frame which is formed integrally with the member 24. Between the member 22 and the member 24 a pneumatic cylinder 26 is mounted, the piston 26*a* of which when moving out of the cylinder pivots the member 22 about the member 25 to lift the rod 21 thereby separating the rods 14,15, to expand the formers 4,5.

Figure 1:
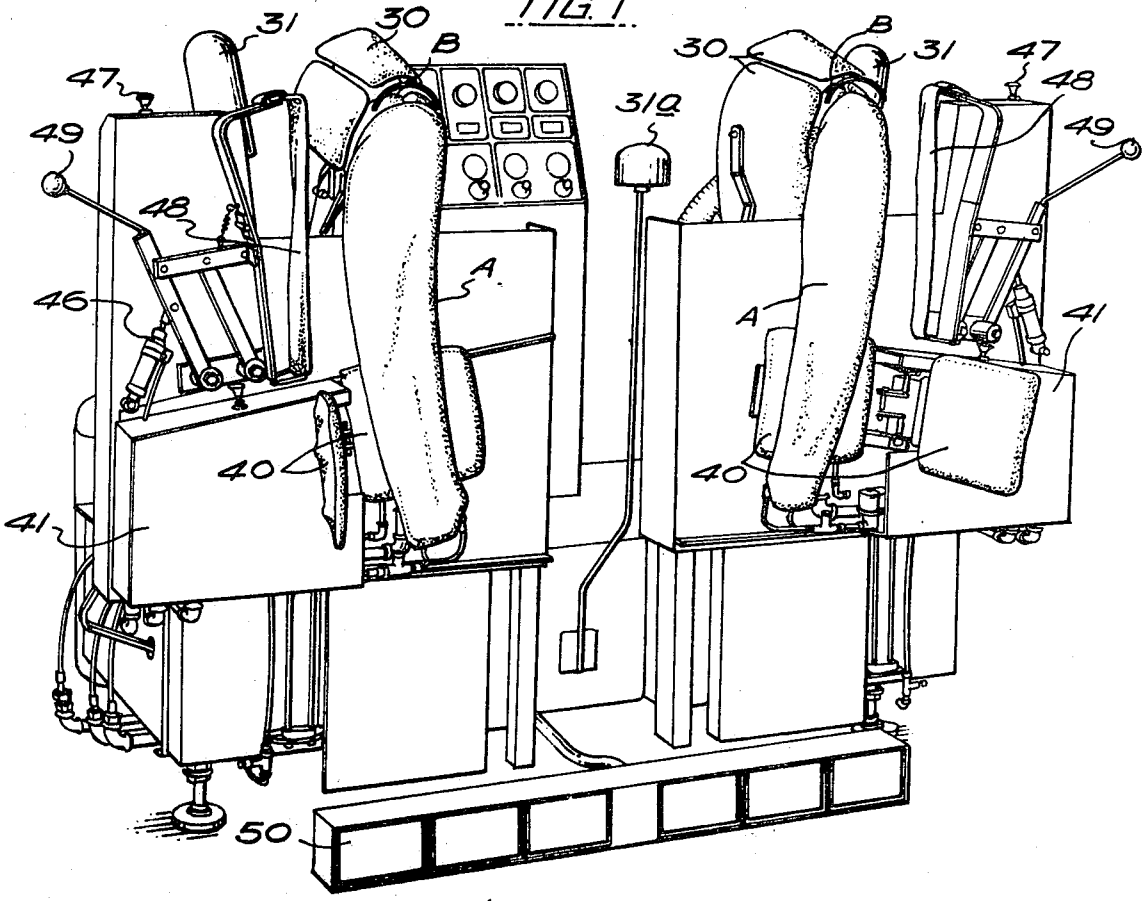
FIG. 1 is a perspective view of the machine.
Figure 2:
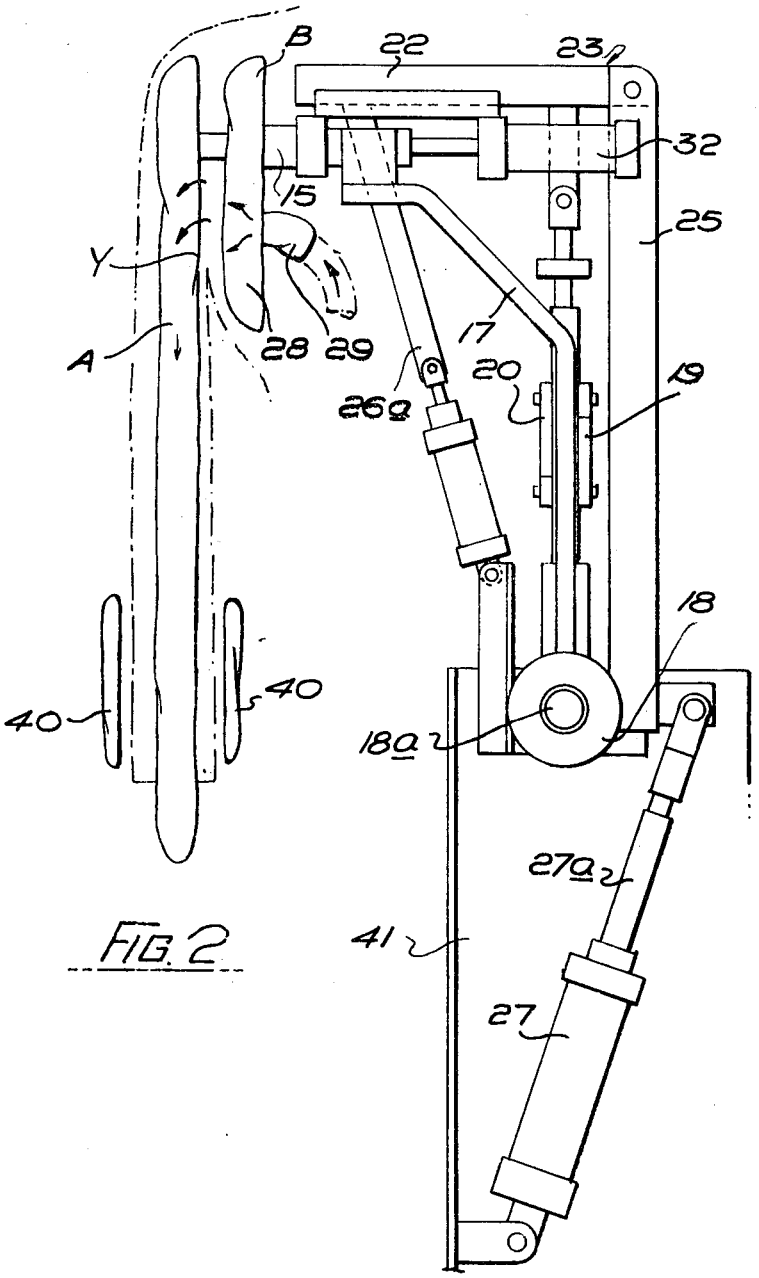
FIG. 2 is a fragmentary side elevation of operating mechanism.

The frame 22 is pivoted to the piston 27*a* of a tilt cylinder 27 (FIG. 2).

The pressing head B is also formed with two perforated plates 1*a* and 2*b*, as shown in FIG. 6, pivoted together on a stud 3*a* and opened and closed in conjunction with the plates 1,2 by the rods 14,15 to expand on contact a bag 28.

The pressing head B of larger diameter than the armhole in enclosed in the bag 28 (FIG. 8) through the backs of which the rods 14,15 pass and to which steam is admitted through an inlet 29 on the back of the bag. Bag 28 is of impervious plastics material and the front part pervious allow the steam to pass therethrough to the sleeve support or form A.

The sleeve support or form A is enclosed in a textile cover and is inserted into the sleeve C of a coat or jacket with the shoulder supported on pads 30, the other shoulder being placed on a rest 31 or 31*a*. The sleeve is drawn up and over the sleeve support or form A with the shoulder over the top of the form with the sleeve support A and the pressing head B in an inclined position by operating the tilt cylinder 27.

A cuff press 40 is mounted on a screen 41 and is operated by a pneumatic cylinder (not shown). A device for forming the cuff of the jacket or coat (FIG. 9) comprises a transverse tube 42 containing a plunger 43 operating against a spring 44 maintained din a compressed condition by a hand operated lever 45 engaging a notch 46 in the tube 42. After the pressing operation the lever 45 is then released from the notch which allows the plunder 43 to move outwards to expand the sleeve.

A press button 47 is operated to actuate the tilt cylinder 27 to bring the form A back to a vertical position.

A substantially U shaped canvas strip 48 is brought into engagement with the outside of the edge of the back of the sleeve by a hand lever 49 or by a pneumatic cylinder 46 to prevent creasing.

Steam is admitted to the bag 28 and into the sleeve as shown by the arrows in FIG. 2 after the arm hole seam has been positioned in the gap between the shoulder pads 30 and the pressing head B and nip cylinders 32 are operated to move the pressing head B into contact with the sleeve support or form A. The pressing head B will now clamp against the sleeve support A at a pressure which will not hurt the operator's fingers if they are trapped.

If the armhole is not set correctly the nip cylinders can be released by a foot pedal. The fore-part of the clamped sleeve, the lapel and the back of the coat or jacket are positioned. The arm hole is shown between the points X and Y on FIG. 2. Pressing head B may be advanced by nip cylinders 32 up to the arm hole. However, pressing head B will not pass through the armhole, since the diameter of pressing head B is substantially greater than that of the jacket armhole. The armhole is shown between the points X and Y on FIG. 2.

Steam, hot air and cold air control levers are provided in known manner by pedals in a control cabinet 50.

The press may operate on an automatic cycle and while pressing the sleeve of one garment the sleeve of a second garment may be positioned on the other member of the press.

The air-jets, mounted on the screen 41, operate to remove the steam from the area between the sleeve form A and the screen. This air continues to blow for the total time of the automatic cycle.

Steam is directed to the sleeve head area of the jacket. Steam will also be emitted from the cuff clamp only is DRY steam has been selected on the Control panel push button. At the end of the period set on the steam timer the steam supply stops and the hot air timer starts.

The sleeve head B clamps against the form A at the pressure set by the control panel dial, hot air is blown into the sleeve head and sleeve and can be selected on a hot air timer of the control box for the pre-set time. At the end of the period set on the hot air timer, the hot air supply stops and the cold ait timer starts.

Cold air is blown into the sleeve head and sleeve to cool and set the garment. At the same time, vacuum is applied to a cuff clamp. At the end of the period set on the cold air timer, the cold air and vacuum stops and all timers re-set. The machine reverts to the Load/Unload position i.e.

The cuff clamp opens

The rear clamp moves away from the sleeve

The front screen descends

The form tilts back to the Load/Unload single

The sleeve head moves away from the shoulder form

The sleeve head tension relaxes.

Warm air blows into the sleeve area

Vacuum is applied continuously to the sleeve head extractor (This is working all the time).

Relax the sleeve form by squeezingtogether the front and rear portions of the form.

Remove the jacket and load next jacket sleeve.

What I claim is:

1. A method of nipping and draping the armhole area of sleeves of jackets comprising the steps of: positioning the sleeve of a jacket on an elongated expansible sleeve form; bringing an expansible enlarged diameter internal pressing head into engagement with said form internally of the shoulder end of the sleeve whereby the seams between the jacket body and the adjacent sleeve which form the armhole area of the jacket are nipped or clamped between said form and said pressing head; and allowing said sleeve to set.

2. Apparatus for nipping and draping the sleeves of jackets comprising: an elongated expansible sleeve form upon which the sleeve of a jacket may be positioned; an internal expansible, enlarged diameter pressing head; means for expanding said head and bringing it into engagement with said form internally of the shoulder end of the sleeve whereby the seams between the jacket body and the adjacent sleeve which form the armhole area of the jacket are nipped or clamped between the said form and said pressing head; and means for introducing treatment fluid through said pressing head.

3. The apparatus defined in claim 2, wherein said means for expanding said head comprise relatively laterally movable members and means for relatively laterally moving said members to expand said pressing head, and said means for introducing treatment fluid through said pressing head further comprise means for directing said treatment fluid into said form for expanding said form.

4. The apparatus defined in claim 2, wherein said pressing head is mounted on a tiltable frame that also mounts said means for expanding said pressing head and means for moving said pressing head toward and away from said form.

5. The method defined to claim 1, further comprising the step of simultaneously pressing the remainder of the sleeve associated with the armhole area being pressed.

* * * * *